US006802467B2

(12) United States Patent
Abba et al.

(10) Patent No.: US 6,802,467 B2
(45) Date of Patent: Oct. 12, 2004

(54) METHOD FOR AXIAL FEEDING OF RIBBON MATERIAL AND A STOCK OF RIBBON MATERIAL COILS FOR AXIAL FEEDING

(75) Inventors: Rodney L. Abba, Oshkosh, WI (US); Robert J. Waldron, Appleton, WI (US); Robert J. Makolin, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 123 days.

(21) Appl. No.: 10/038,795

(22) Filed: Dec. 31, 2001

(65) Prior Publication Data

US 2003/0122009 A1 Jul. 3, 2003

(51) Int. Cl.[7] ..... B65H 18/28
(52) U.S. Cl. ..... 242/167; 242/160.2; 242/551
(58) Field of Search ..... 242/160.2, 167, 242/520, 551

(56) References Cited

U.S. PATENT DOCUMENTS

| | | | |
|---|---|---|---|
| 940,231 | A | 11/1909 | Blessing |
| 1,178,566 | A | 4/1916 | Wright |
| 1,333,147 | A | 3/1920 | Wright |
| 1,958,692 | A | 9/1930 | Besal et al. |
| 2,887,281 | A | 5/1959 | Caufield |
| 3,089,588 | A | 5/1963 | Correll |
| 3,285,446 | A | 11/1966 | Strickland |
| 3,379,386 | A | 4/1968 | Bobolts et al. |
| 3,719,330 | A | 3/1973 | Dell Antonio et al. |
| 3,806,054 | A | 4/1974 | Johnson et al. |
| 3,810,591 | A | 5/1974 | Haven |
| 3,889,891 | A | 6/1975 | Walker |
| 3,934,775 | A | 1/1976 | Keller |
| 4,022,396 | A | 5/1977 | Manchester et al. |
| 4,597,255 | A | 7/1986 | Hunter et al. |
| 4,610,408 | A | 9/1986 | Box et al. |
| 4,773,610 | A | 9/1988 | Nordlof |
| 5,174,449 | A | 12/1992 | Ball |
| 5,301,889 | A | 4/1994 | Ball |
| 5,310,056 | A | 5/1994 | Ball |
| 5,456,098 | A | 10/1995 | Hartwig et al. |
| 5,474,208 | A | 12/1995 | Ball |
| 5,482,225 | A | 1/1996 | Hartwig et al. |
| 5,911,386 | A | 6/1999 | Martin |
| 5,927,051 | A | 7/1999 | O'Connor et al. |
| 5,966,905 | A | 10/1999 | O'Connor et al. |
| 5,987,851 | A | 11/1999 | O'Connor |

FOREIGN PATENT DOCUMENTS

| | | | |
|---|---|---|---|
| JP | 62185659 | A | 8/1987 |
| JP | 62185660 | A | 8/1987 |
| JP | 63300058 | A | 12/1988 |
| JP | 02117713 | A | 5/1990 |

*Primary Examiner*—John Q. Nguyen

(57) ABSTRACT

A method of preparing coils of wound ribbon to reduce twisting thereof during continuous axial ribbon feed to a processing machine. Each coil has a sequence of turns wound about a central axis and includes a central end at an inner-most turn of the sequence of turns and an outer end at an outer-most turn of the sequence of turns. The method includes orienting a first coil and a second coil so that the first and second coils are wound in identical directions and splicing the central end of the first coil to the central end of the second coil such that at least some twists developed during axial ribbon feed of the first coil are removed during axial ribbon feed of the second coil.

23 Claims, 4 Drawing Sheets

METHOD FOR AXIAL FEEDING OF RIBBON MATERIAL AND A STOCK OF RIBBON MATERIAL COILS FOR AXIAL FEEDING

BACKGROUND OF THE INVENTION

The present invention relates generally to continuously supplying flexible raw material generally in the form of a web to a processing machine, and more particularly to a stock of ribbon material and methods for controlling twisting of the ribbon material fed to the processing machine.

Conventional processing machines, such as those used to convert narrow ribbons of raw material into finished product, run most efficiently when a continuous feed of raw material is provided. If continuous feed of raw material is not maintained, the machine must be shut down to re-thread the ribbon material. Shutting down the machine negatively impacts the efficiency of the machine, especially machines used in high volume processes such as the production of feminine care products.

Raw absorbent material used to produce feminine care products is initially manufactured as a web of absorbent material measuring one meter or more in width. The processing machine cannot process such a wide web, so the material is trimmed to form many ribbons of a more usable narrow width. The wide web is suitably scored or sheared to form the ribbons. Typically, the ribbons are then wound onto cores to form coils or "pancake slits", so-called due to the fact they resemble pancakes when laid flat. Each coil has a thickness substantially equal to a width of the ribbon material, and each successive revolution or turn of ribbon substantially overlies the preceding revolution so that the coil is no thicker than the ribbon material is wide.

The coils are shipped to a factory where the processing machine is located, and one coil at a time is mounted on a horizontal axis spindle for continuous feed of raw material into the processing machine. The machine pulls the ribbon in a direction tangential to the coil, i.e., parallel to a plane of the coil and perpendicular to an axis of the coil, so that there is no twisting of the ribbon during feeding. The spindle is a variable-speed motorized spindle with sufficient capacity for mounting only one coil of absorbent material. The spindle is variable-speed to keep tension in the ribbon as it is fed into the machine. It will be understood that at a constant linear feed rate, the coil will rotate faster as its supply of ribbon is consumed by the machine. Due to the high cost of each spindle, no more than two spindles are typically provided at the machine. Thus, as a first coil is consumed, a second coil is mounted on the second spindle, and the trailing end of the first coil is spliced to a leading end of the second coil.

An obvious disadvantage of this arrangement is that an operator must be standing by to load coils as they are consumed by the machine. The time period between changing coils (referred to as runout time) will vary with the length of the material on the coil and the speed of use by the processing machine. In the case of a relatively high throughput feminine pad machine, a typical one thousand lineal meter coil of absorbent material will be consumed in three to nine minutes. Due to this relatively short runout time, the processing machine requires constant manpower to maintain continuous feed. Moreover, the short runout time and the difficulty of loading the bulky coil on the spindle increases the likelihood that the splice will fail (e.g., due to operator error or mechanical problems in splicing) and the likelihood that the machine will have to be shutdown for re-threading.

There are other methods of providing continuous feed material to a processing machine. Rather than forming the ribbon material into narrow width coils, the ribbon material may be wound on large capacity spools. Unlike the coils described above, such spools are many times wider than the width of the ribbon, and hold significantly more material than the coils. Spools increase the runout time of the raw material but have significant disadvantages. Significant capital investment is required as compared to use of coils because most machines built to unwind one narrow coil at a time are not equipped to unwind large spools. For example, a powered turntable or "unwinder" is likely to be required to unwind the spool, and significantly more power will be consumed to turn the unwinder than the spindle described above. The cost of spooled raw materials is typically higher than that of coils because few raw material suppliers have spooling capability. In most cases, the material must be shipped from the point of manufacture to an external spooling vendor, which increases cost.

Another method of continuously feeding material to a processing machine is shown in U.S. Pat. No. 1,178,566 (Wright). The ribbon material is formed into a stack of coils, and an end of the upper coil is pulled parallel to the axis of the coil into the machine. This arrangement causes the ribbon material to twist as it is unwound. The patent shows a device for removing the twists including a rotatable guide which rotates in response to twists in the ribbon and a powered turntable which rotates the coils at intervals in response to rotation of the guide.

SUMMARY OF THE INVENTION

In one aspect, the present invention provides a method of preparing coils of wound ribbon to reduce twisting thereof during continuous axial ribbon feed to a processing machine. Each coil has a sequence of turns wound about a central axis and includes a central end at an inner-most turn of the sequence of turns and an outer end at an outer-most turn of the sequence of turns. The method includes orienting a first coil and a second coil so that the first and second coils are wound in identical directions and splicing the central end of the first coil to the central end of the second coil such that at least some twists developed during axial ribbon feed of the first coil are removed during axial ribbon feed of the second coil.

In another aspect, the present invention provides a method of preparing coils of wound ribbon to reduce twisting thereof during continuous axial ribbon feed to a processing machine. Each coil has a sequence of turns wound about a central axis and includes a central end at an inner-most turn of the sequence of turns and an outer end at an outer-most turn of the sequence of turns. The method includes orienting a first coil and a second coil so that the first and second coils are wound in identical directions and splicing the outer end of the first coil to the outer end of the second coil such that at least some twists developed during axial ribbon feed of the first coil are removed during axial ribbon feed of the second coil.

In yet another aspect of the present invention, a stock of flexible ribbon material adapted for continuous axial feed to a processing machine includes a plurality of coils of the ribbon material. Each coil has a sequence of turns wound about a central axis of the coil and includes a central end at an inner-most turn of the sequence of turns and an outer end at an outer-most turn of the sequence of turns. Each coil of the plurality of coils is wound about its respective central axis in an identical direction to the other coils in the plurality of coils. The central end of a first coil of the plurality of coils is connected to a central end of a second coil of the plurality of coils such that at least some twists developed during axial feeding of the first coil are removed during axial feeding of the second coil.

In still another aspect of the present invention, a stock of flexible ribbon material adapted for continuous axial feed to a processing machine includes a plurality of coils of the ribbon material. Each coil has a sequence of turns wound about a central axis of the coil and includes a central end at an inner-most turn of the sequence of turns and an outer end at an outer-most turn of the sequence of turns. The outer end of a first coil of the plurality of coils is connected to the outer end of a second coil of the plurality of coils such that at least some twists developed during axial feeding of the first coil are removed during axial feeding of the second coil.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE EMBODIMENTS

Figure 1:
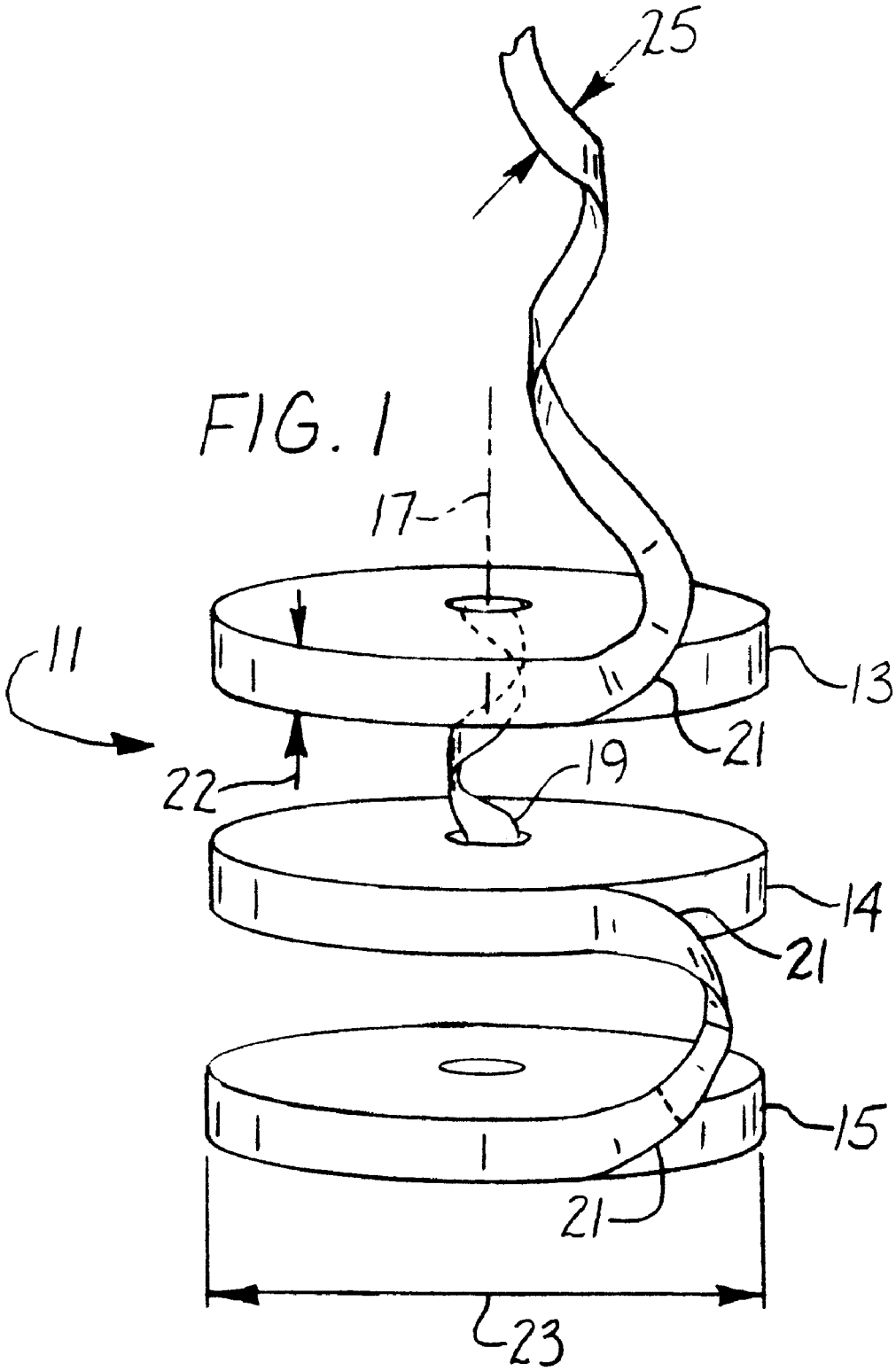
FIG. 1 is a perspective view of a stock of coils connected according to one embodiment of the present invention.
Figure 3:
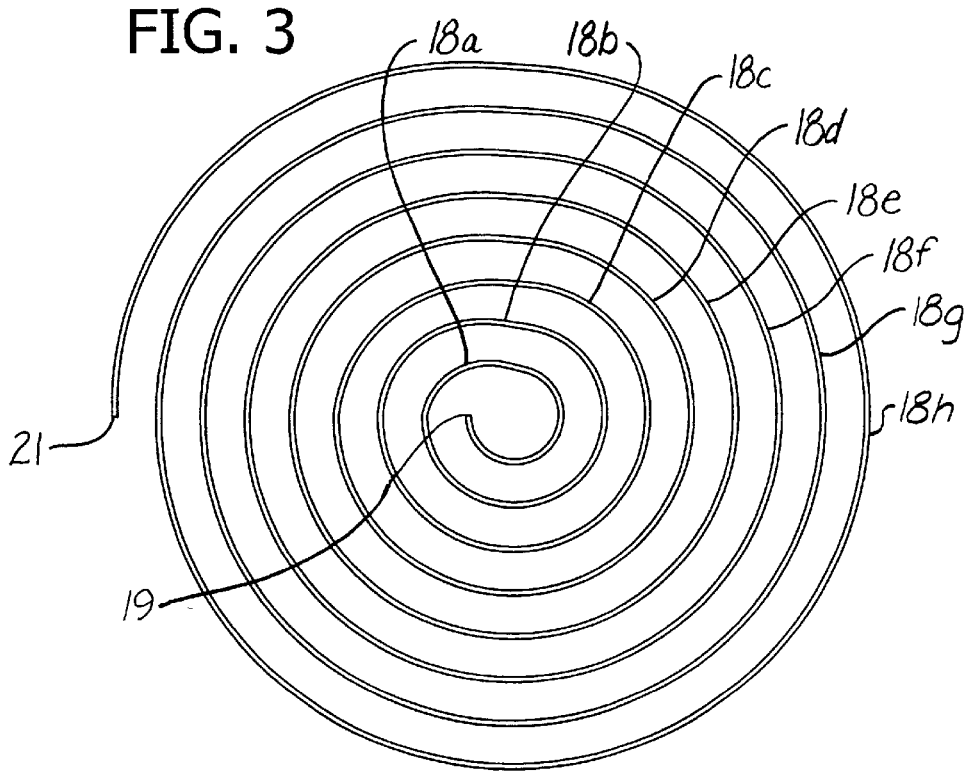
FIG. 3 is a plan view of an illustrative coil wound in a counterclockwise direction.

Referring now to the drawings and in particular to FIG. 1, a stock of flexible ribbon material adapted for continuous axial feed to a processing machine (not shown) is generally designated by the reference numeral 11. The stock includes a first or upper coil 13, a second or middle coil 14 and a third or lower coil 15 spliced end-to-end as further described below. Each coil 13–15 is formed of ribbon material wound about a central axis 17 of the coil. Each coil has a sequence of turns (e.g., turns 18*a*–18*h* (FIG. 3) wound about the central axis 17. Although FIG. 3 shows eight turns, those skilled in the art will appreciate that the coil may include fewer and more desirably includes many more turns wound about the central axis 17. Each coil also includes a central end 19 at an inner-most turn 18*a* of the sequence of turns and an outer end 21 at an outer-most turn 18*h* of the sequence of turns. In general, the central end 19 is adjacent the central axis 17 and the outer end 21 is at an outer periphery of the coil. The ribbon material is sheared or "slit" from a wide roll (e.g., having a width of one meter or more) of absorbent raw material. The resulting coils 13–15 of one embodiment have a thickness 22 between about 20 mm and about 50 mm, desirably about 37 mm and a diameter 23 between about one meter and about two meters, e.g., 1.2 meters. Note that in one embodiment the thickness 22 of each coil is substantially equal to a width 25 of the ribbon and that each turn of ribbon substantially overlies the preceding revolution about the central axis. It will be understood that the thickness 22 and diameter 23 of the coil may be other than as described herein without departing from the scope of the present invention.

The coils 13–15 of the stock 11 are sequenced by stacking the middle coil 14 on the lower coil 15 and the upper coil 13 on the middle coil. Note that the coils may be sequenced other than by stacking, e.g., they may be placed horizontally adjacent one another. In this embodiment, the coils are oriented so that each is wound in the same direction. Although all of the coils may be wound in a clockwise direction without departing from the scope of the present invention, in the embodiment shown in FIG. 1, all the coils are wound in a counterclockwise direction (as viewed from above the coils). As described more fully below, ends of the coils are then spliced such that at least some twists developed during axial ribbon feed of the upper coil 13 are removed during axial ribbon feed of the middle coil 14. In the embodiment shown in FIG. 1, the central end 19 of the upper coil 13 is spliced to the central end of the middle coil 14, and the outer end 21 of the middle coil is spliced to the outer end of the lower coil 15. The ends are suitably spliced such as by applying double-sided adhesive tape to one of the ends to be spliced and pressing the other end to be spliced on the tape so that the ends overlap. Other methods of splicing, such as applying adhesive directly to the ribbon may be used without departing from the scope of the present invention. Further, the ends may be lapped or butted without departing from the scope of the present invention.

As used herein, "axial feed" or "axial ribbon feed" means pulling the ribbon material in a twist-promoting direction having a component parallel to, or coincident with, the axis of each coil 13–15 and which forms an angle with respect to a plane of the coil which causes or promotes twisting of the ribbon material during unwinding. Twist-promoting direction is more fully described in our co-pending applications filed simultaneously herewith entitled METHOD AND APPARATUS FOR AXIAL FEED OF RIBBON MATERIAL and TWIST CONTROLLING DEVICE, ROTATABLE NIP AND AXIAL FEED SYSTEM, both of which are incorporated herein by reference.

As the coils 13–15 are unwound during axial ribbon feed, the unwound ribbon material will twist. For each turn of the ribbon removed or unwound from the coil, two 180° twists will be introduced into the unwound material. The twisting is generally formed in either a clockwise direction or a counterclockwise direction, depending upon which end of the coil is pulled first and upon the winding direction of the coil. In the first embodiment, each coil 13–15 is wound about its central axis 17 in a counterclockwise direction (as shown in FIG. 3) as viewed from above the coils. The upper coil 13 is unwound by axial feeding from its outer end (or leading end) 21, which causes the ribbon material of the upper coil to generally unwind in a clockwise direction thus causing what is referred to as "clockwise twisting" of the unwound ribbon material. Due to the splicing pattern, after the upper coil 13 is unwound, the middle coil 14 is unwound from its central end 19 so that the ribbon generally unwinds in a reversed or counterclockwise direction causing counterclockwise twisting. Because the twisting direction of the ribbon unwound from the middle coil 14 is opposite that of the ribbon unwound from the upper coil 13, the twists formed in the previously unwound ribbon (that of upper coil 13) are at least partially and desirably entirely removed during axial ribbon feed of the middle coil. Likewise, if the upper coil is omitted and axial feed begins with the central end 19 of the middle coil 14, twists formed during axial ribbon feed of the middle coil are at least partially and desirably entirely removed during axial ribbon feed of the lower coil 15 because they twist in the opposite direction.

Figure 2:
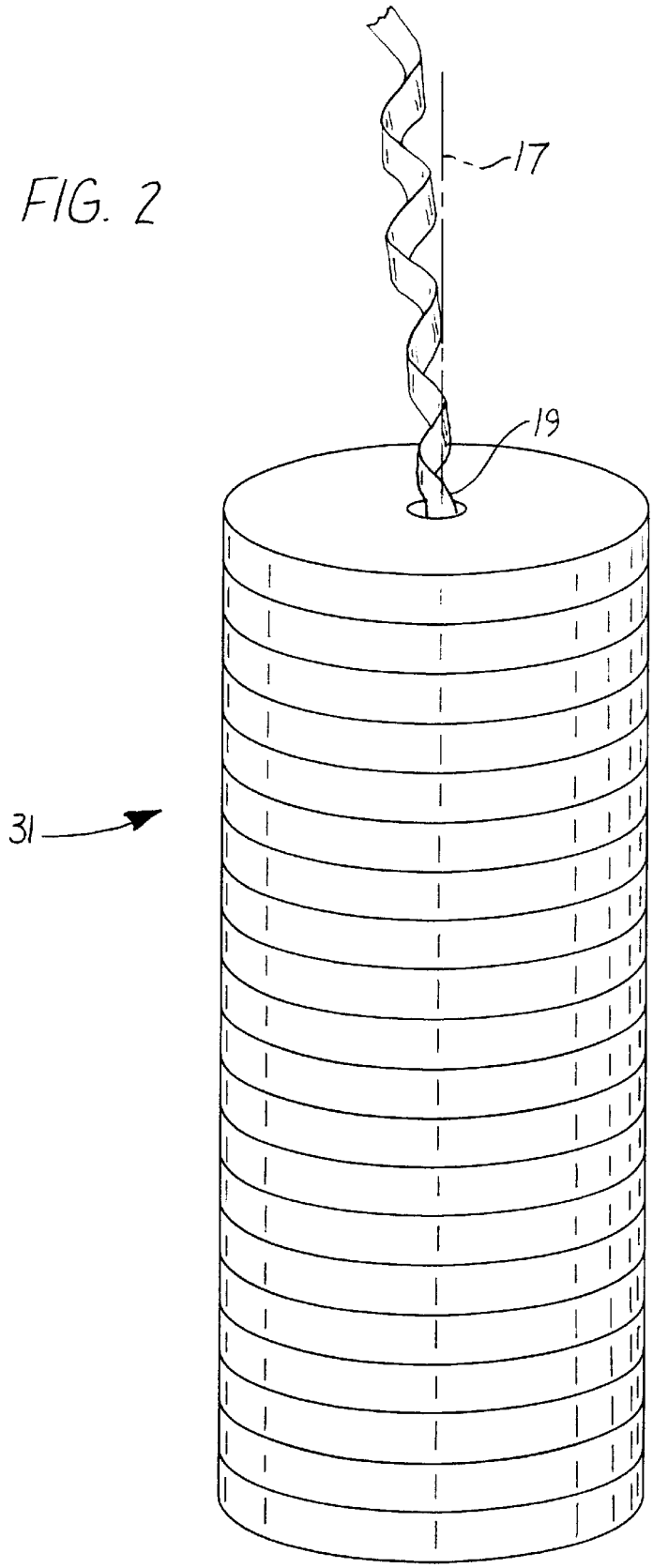
FIG. 2 is a perspective view of a stock of twenty coils.

The alternating pattern of splicing of the first embodiment is desirably repeated for all the coils in a large stock of ribbon material, such as the stock 31 of coils shown in FIG. 2. The twisting in the unwound ribbon during unwinding twenty or more coils in the set will thus be substantially limited to the number of twists caused by unwinding just one coil if each coil has the same number of turns of ribbon.

Figure 4:
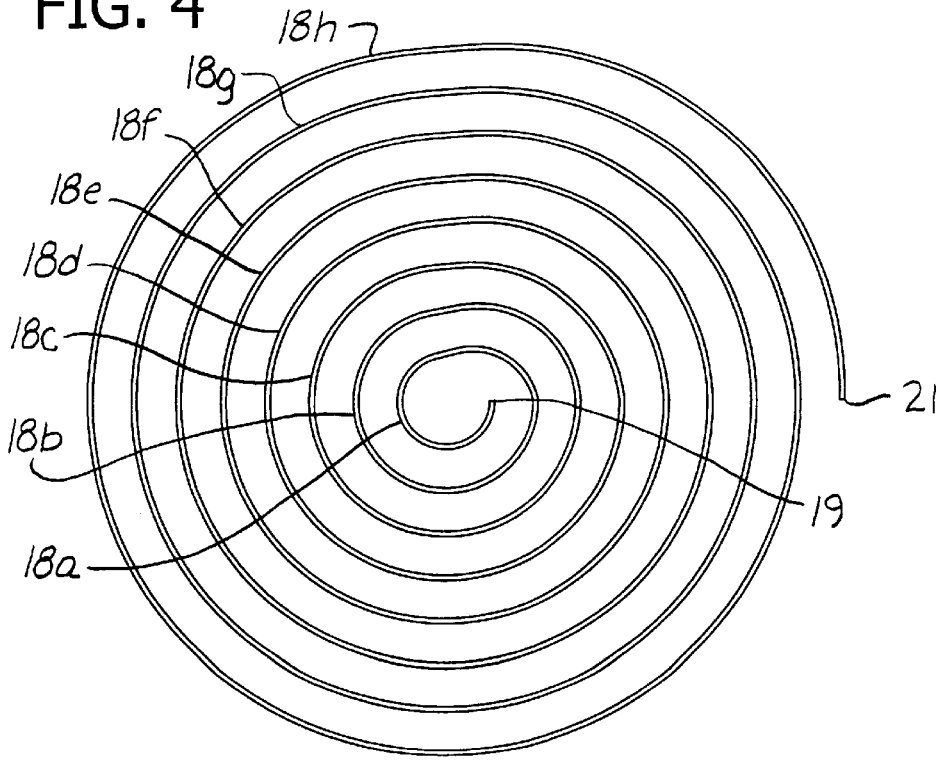
FIG. 4 is a plan view of an illustrative coil wound in a clockwise direction.
Figure 5:
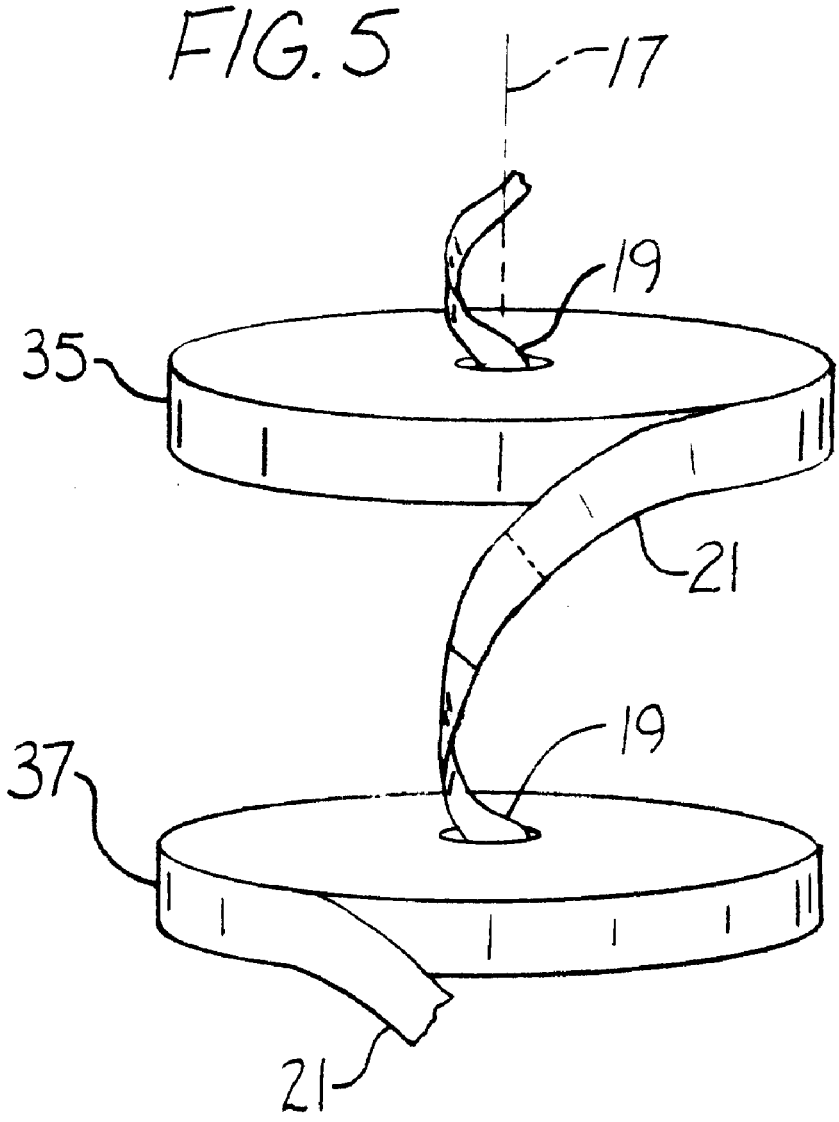
FIG. 5 is a perspective view of coils connected according to a second embodiment of the invention.

In a second embodiment shown in FIG. 5, an upper coil 35 is oriented so that it is wound about its central axis 17 in the clockwise direction (as shown in FIG. 4), and a lower coil 37 is oriented so that it is wound in the counterclockwise direction (FIG. 3). The outer end 21 of the upper coil 35 is spliced, as described above, to the central end 19 of the lower coil. Axial feed of the upper coil 35 begins at its central end 19 so that unwinding is clockwise and causes clockwise twisting. After the upper coil 35 is unwound, the lower coil 37 is axially fed and the ribbon material generally unwinds in a reversed or counterclockwise direction to cause counterclockwise twisting. Thus, twists developed during axial ribbon feed of the upper coil 35 are at least partially and desirably entirely removed or untwisted during axial ribbon feed of the lower coil 37.

The pattern of winding orientation of the second embodiment is desirably repeated for all the coils in a large stock of ribbon material, such as the large stock 31 of coils shown in FIG. 2. It is contemplated that the stock 31 may include a continuous supply of ribbon, rather than spliced coils as described above. In other words, a long, continuous ribbon could be wound to form several coils. The winding direction of the coils could be alternated as described above to reverse the twisting direction in every other coil.

The steps of receiving the ribbon material, sequencing the coils in the order described in the embodiments, and splicing the coils may be performed at the place of manufacture of the ribbon material, at the facility where the processing machine is located, or less desirably, at an intermediate facility. Prior to the splicing step discussed above, the central end 19 of each coil is exposed to prepare the coil for splicing. Often, the coils include a rigid central core (not shown) upon which the coil was wound during manufacturing. If there is a core, it is removed to expose the central end of the ribbon located at the center of the coil. If there is no core, the central end is located and pulled out to partially unwind the coil from the center to allow sufficient slack for splicing the ends.

Before or after splicing, the coils are stacked and bound together to form a stock of ribbon material. The central axes 17 of the coils are generally aligned, as shown in FIGS. 1 and 2. The coils are typically stacked flat on a horizontal surface so that the axis 17 of each coil is oriented vertically as shown in FIGS. 1 and 2, but may alternatively be aligned in a row on their perimeters and bound together so the axis of each coil is oriented horizontally. The coils are then taken or shipped to the processing machine. Typically, the central end 19 or outer end 21 of the upper coil in the stock 11 is spliced to the preceding stock of coil so that continuous feed to the processing machine is not interrupted.

It should be emphasized that embodiments of the invention are described above with respect to just two or three coils. The embodiments apply to a stack of as few as two or three coils, but it will be understood that 10 to 20 or more coils will desirably be spliced together to form a larger stock of coils 31 as shown in FIG. 2. Generally, each additional coil in the stack results in an incremental increase in runout time and a corresponding decrease in labor required for continuous feed of the machine.

During axial feeding, the stock should be positioned a sufficient distance from a processing portion (e.g., a cutting tool) of the processing machine so as to inhibit twists from entering the processing portion. The machine may also include turnbars or nips (not shown) suitably positioned to inhibit twists from entering the processing portion of the machine. Suitable turnbars and nips are described in the aforementioned co-pending applications entitled METHOD AND APPARATUS FOR AXIAL FEED OF RIBBON MATERIAL and TWIST CONTROLLING DEVICE, ROTATABLE NIP AND AXIAL FEED SYSTEM, both of which are incorporated herein by reference. The stock of ribbon material is desirably placed on a non-rotating horizontal surface on or adjacent the processing machine so that the coils are not rotated during feeding into the machine. It is contemplated, however, that the coils could be mounted on a rotatable or motorized turntable, unwinder or horizontal-axis spindle (not shown), but such mounting may not be required due to the twist reducing nature of the stacked coils of both embodiments.

An example processing machine for use with this invention is a feminine pad processing machine manufactured by Keller Technology Corporation of Buffalo, N.Y. Other types of processing machines are contemplated.

Using the method described above significantly increases the runout time of the ribbon material as compared to mounting just one coil at a time on the processing machine. In a test of the invention using a stack of two coils fed into the example processing machine, no twists entered the processing portion of the machine, and the splice between the coils did not fail. Because two or more coils are loaded at one time, the invention lessens the manpower required and cost to operate the processing machine. Further, because no motorized turntable or unwinder is required, the capital expenditure is minimized.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A method of preparing coils of wound ribbon to reduce twisting thereof during continuous axial ribbon feed to a processing machine, each coil having a sequence of turns wound about a central axis and including a central end at an inner-most turn of said sequence of turns and an outer end at an outer-most turn of said sequence of turns, the method comprising:

a) orienting a first coil and a second coil so that said first and second coils are wound in identical directions, and b) splicing the central end of the first coil to the central end of the second coil such that at least some twists developed during axial ribbon feed of the first coil are removed during axial ribbon feed of the second coil.

2. A method as set forth in claim 1 further comprising:

a) orienting a third coil so that it is wound in an identical direction to said first and second coils, and b) splicing the outer end of the second coil to the outer end of the third coil.

3. A method as set forth in claim 2 further comprising stacking the first coil on the second coil and stacking the second coil on the third coil.

4. A method as set forth in claim 1 further comprising stacking the first coil on the second coil.

5. A method as set forth in claim 1 further comprising axially feeding the ribbon into the processing machine.

6. A method as set forth in claim 1 further comprising axially feeding the ribbon into the processing machine without rotating the coils.

7. A method of preparing coils of wound ribbon to reduce twisting thereof during continuous axial ribbon feed to a processing machine, each coil having a sequence of turns wound about a central axis and including a central end at an inner-most turn of said sequence of turns and an outer end at an outer-most turn of said sequence of turns, the method comprising:

a) orienting a first coil and a second coil so that said first and second coils are wound in identical directions, and b) splicing the outer end of the first coil to the outer end of the second coil such that at least some twists developed during axial ribbon feed of the first coil are removed during axial ribbon feed of the second coil.

8. A method as set forth in claim 7 further comprising stacking the first coil on the second coil.

9. A method as set forth in claim 7 further comprising axially feeding the ribbon into the processing machine.

10. A method as set forth in claim 7 further comprising axially feeding the ribbon into the processing machine without rotating the coils.

11. A stock of flexible ribbon material adapted for continuous axial feed to a processing machine, the stock comprising:

a plurality of coils of said ribbon material, each coil having a sequence of turns wound about a central axis of the coil and including a central end at an inner-most turn of said sequence of turns and an outer end at an outer-most turn of said sequence of turns, each coil of said plurality of coils being wound about its respective central axis in an identical direction to the other coils in said plurality of coils, the central end of a first coil of said plurality of coils being connected to a central end of a second coil of said plurality of coils such that at least some twists developed during axial feeding of the first coil are removed during axial feeding of the second coil.

12. A stock as set forth in claim 11 wherein the outer end of the second coil is connected to an outer end of a third coil of said plurality of coils.

13. A stock as set forth in claim 11 wherein the ribbon material is an absorbent material.

14. A stock as set forth in claim 11 wherein the ribbon material is an absorbent material adapted for making a feminine care product.

15. A stock as set forth in claim 11 wherein each of the plurality of coils has a thickness substantially equal to a width of the ribbon material.

16. A stock as set forth in claim 11 wherein said plurality of coils are arranged in a stack.

17. A stock as set forth in claim 16 wherein said stack includes at least about twenty coils.

18. A stock of flexible ribbon material adapted for continuous axial feed to a processing machine, the stock comprising:

a plurality of coils of said ribbon material, each coil having a sequence of turns wound about a central axis of the coil and including a central end at an inner-most turn of said sequence of turns and an outer end at an outer-most turn of said sequence of turns, each coil of said plurality of coils being wound about its respective central axis in an identical direction to the other coils in said plurality of coils, the outer end of a first coil of said plurality of coils being connected to the outer end of a second coil of said plurality of coils such that at least some twists developed during axial feeding of the first coil are removed during axial feeding of the second coil.

19. A stock as set forth in claim 18 wherein the ribbon material is an absorbent material.

20. A stock as set forth in claim 18 wherein the ribbon material is an absorbent material adapted for making a feminine care product.

21. A stock as set forth in claim 18 wherein each of the coils has a thickness substantially equal to a width of the ribbon material.

22. A stock as set forth in claim 21 wherein said plurality of coils are arranged in a stack.

23. A stock as set forth in claim 22 wherein said stack includes at least about twenty coils.

* * * * *